US010183819B2

(12) United States Patent
Phillips et al.

(10) Patent No.: US 10,183,819 B2
(45) Date of Patent: Jan. 22, 2019

(54) ASSEMBLY FOR PRINTER HAVING DAMPED MEDIA TRAY

(71) Applicant: HEWLETT-PACKARD DEVELOPMENT COMPANY, L.P., Houston, TX (US)

(72) Inventors: Jesse Phillips, San Diego, CA (US); Mike W. Munro, San Diego, CA (US); Josh Yasbek, Portland, OR (US); Alexander M. Nameroff, Vancouver, WA (US); John Pruyn, Portland, OR (US); Michael A. Fairchild, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 15/333,346

(22) Filed: Oct. 25, 2016

(65) Prior Publication Data

US 2018/0115668 A1 Apr. 26, 2018

(51) Int. Cl.

| | |
|---|---|
| ***B65H 1/04*** | (2006.01) |
| ***B65H 1/14*** | (2006.01) |
| ***B65H 1/08*** | (2006.01) |

(52) U.S. Cl.

CPC ..... *B65H 1/14* (2013.01); *B65H 1/04* (2013.01); *B65H 1/08* (2013.01); *B65H 2403/422* (2013.01); *B65H 2403/483* (2013.01); *B65H 2403/544* (2013.01); *B65H 2403/61* (2013.01); *B65H 2405/15* (2013.01); *B65H 2405/35* (2013.01)

(58) Field of Classification Search

CPC ..... B65H 1/08; B65H 1/14; B65H 2403/483; B65H 2403/61; B65H 2405/35; F16F 2232/02; F16F 9/12; F16F 9/145

See application file for complete search history.

(56) References Cited

U.S. PATENT DOCUMENTS

| | | | | |
|---|---|---|---|---|
| 5,839,548 | A * | 11/1998 | Parker | B60R 7/06 188/82.1 |
| 6,773,182 | B2 | 8/2004 | Yang | |
| 7,121,542 | B2 * | 10/2006 | Okamoto | B65H 1/08 221/227 |
| 7,240,899 | B2 * | 7/2007 | Amamoto | B65H 1/12 271/126 |
| 7,708,269 | B2 | 5/2010 | Nakashima et al. | |

(Continued)

FOREIGN PATENT DOCUMENTS

| | | | |
|---|---|---|---|
| JP | 11171352 | A * | 6/1999 |
| JP | H11171352 | A | 6/1999 |

*Primary Examiner* — Jeremy R Severson

(74) *Attorney, Agent, or Firm* — HP Inc. Patent Department

(57) ABSTRACT

An assembly of a device having a component, the assembly including a damper having a damper gearwheel coupled to a damper member. The damper member has a first condition restricting motion of the component of the device to a first rate in a first direction and a second condition restricting motion of the component of the device to a second rate in the first direction slower than the first rate. The damper gearwheel is rotationally fixed relative to the damper member when the damper is in the first condition. The damper gearwheel is rotatable relative to the damper member when the damper is in the second condition.

15 Claims, 13 Drawing Sheets

(56) References Cited

U.S. PATENT DOCUMENTS

| | | | | |
|---|---|---|---|---|
| 7,789,384 | B2 | 9/2010 | Silverbrook | |
| 8,511,676 | B2 * | 8/2013 | Kitamura | B65H 1/14 271/152 |
| 8,602,409 | B2 * | 12/2013 | Sekiguchi | B65H 1/14 271/147 |
| 9,415,957 | B2 * | 8/2016 | Fuda | B65H 1/14 |
| 2004/0155397 | A1 * | 8/2004 | Gaarder | B65H 3/06 271/10.11 |
| 2004/0218952 | A1 | 11/2004 | Teo et al. | |
| 2011/0120823 | A1 * | 5/2011 | Hansen | E01F 13/028 188/272 |
| 2013/0243448 | A1 * | 9/2013 | Naoi | B65H 1/14 399/23 |
| 2014/0125005 | A1 * | 5/2014 | Matsushima | B65H 1/14 271/147 |
| 2016/0159588 | A1 * | 6/2016 | Mizuguchi | B65H 31/26 271/147 |
| 2017/0036877 | A1 * | 2/2017 | Izumichi | B65H 29/52 |

* cited by examiner

ASSEMBLY FOR PRINTER HAVING DAMPED MEDIA TRAY

BACKGROUND

Printers are provided with a tray for receiving media (e.g., paper) to be printed on. The tray is moveable within the printer between a feeding position where media is fed from the tray to an automatic document feeder and a lower loading position where an operator can load additional media onto the tray.

DETAILED DESCRIPTION

Figure 1:
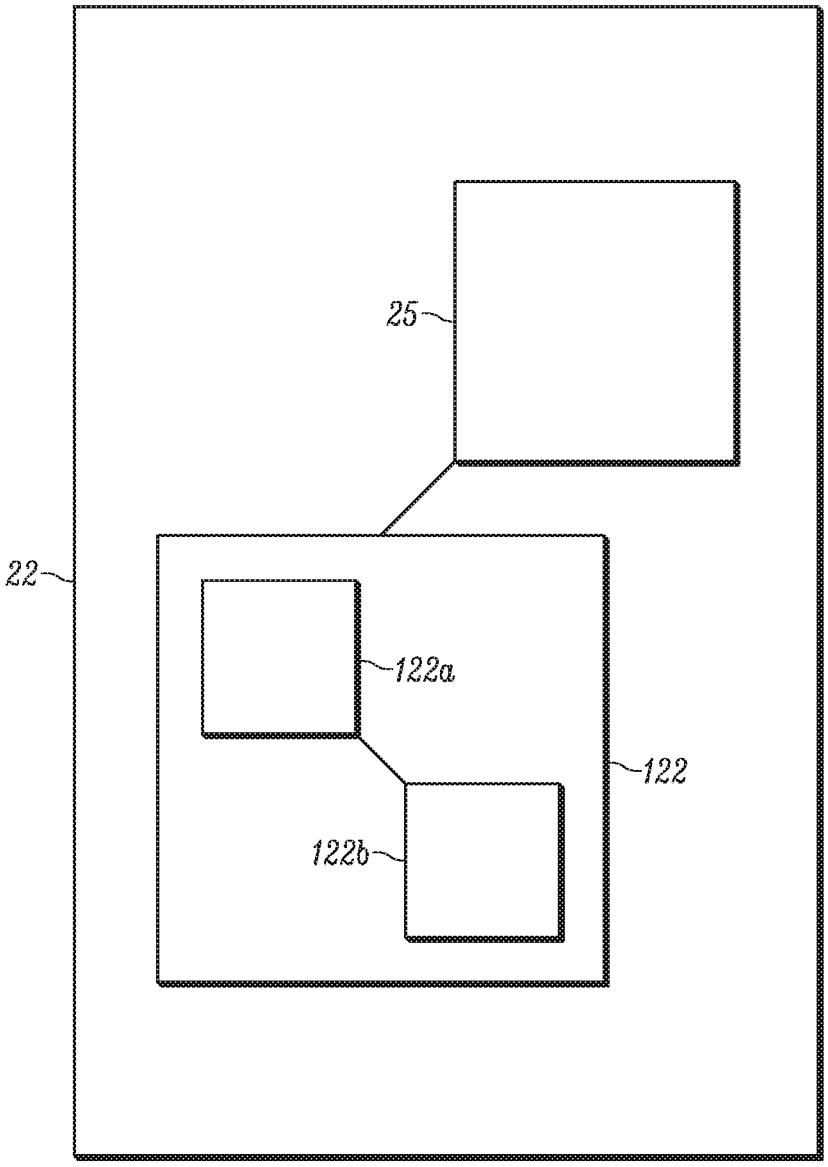
FIG. 1 is a schematic illustration of a device including an example damper assembly.
Figure 2:
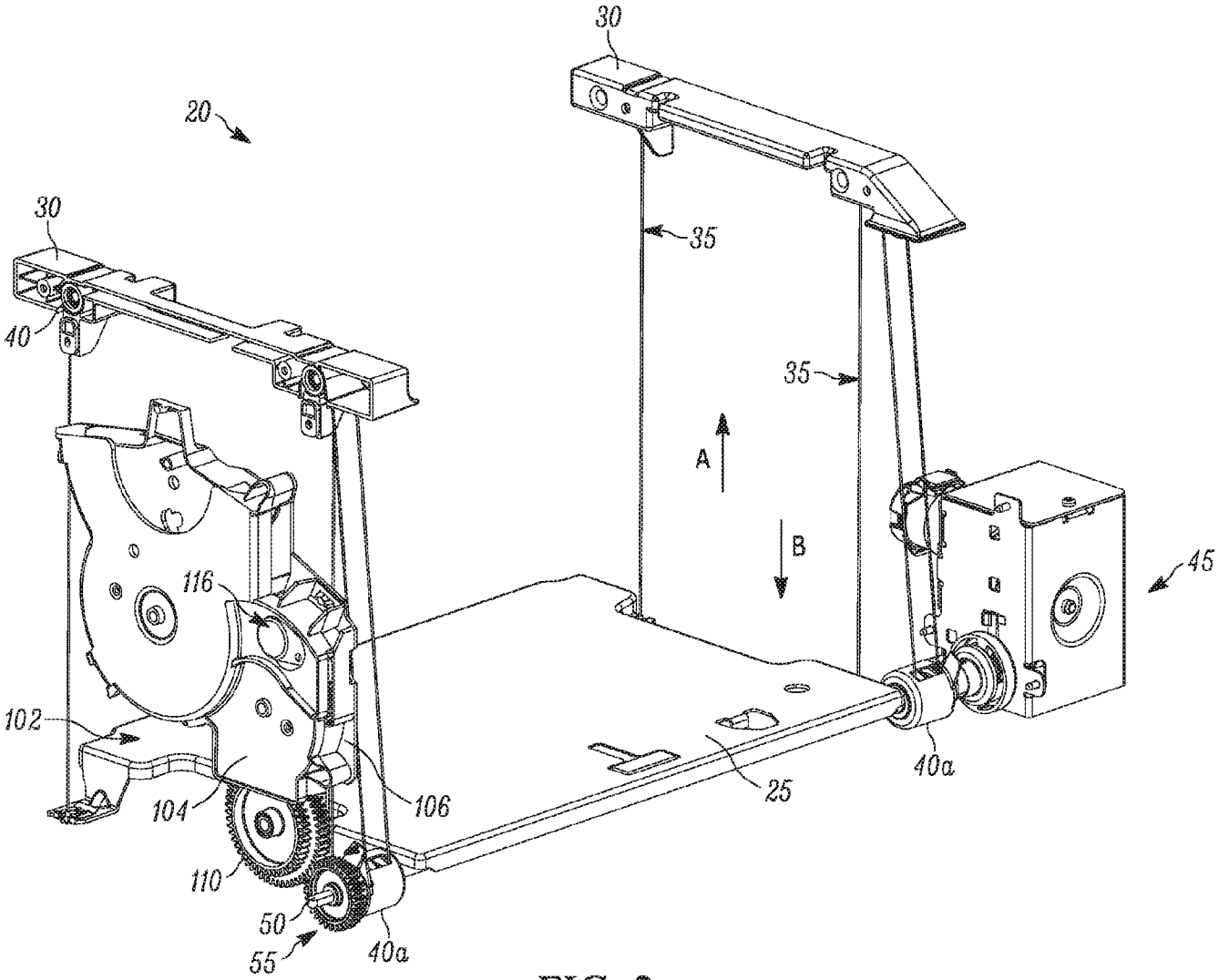
FIG. 2 is an isometric view of the damper assembly of FIG. 1 used with a media transport assembly.
Figure 3:
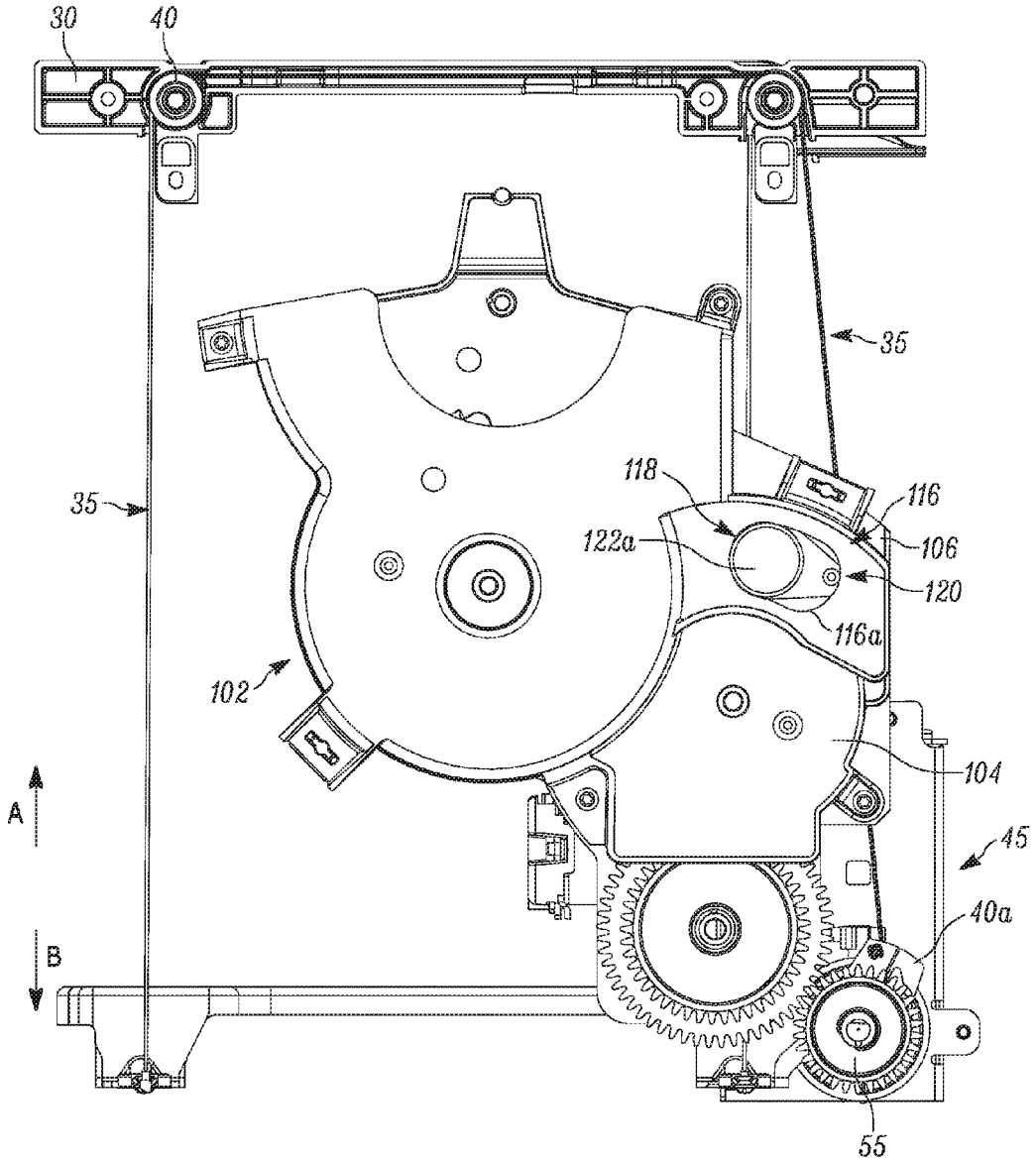
FIG. 3 is a side view of the damper assembly and media transport assembly of FIG. 2.
Figure 4:
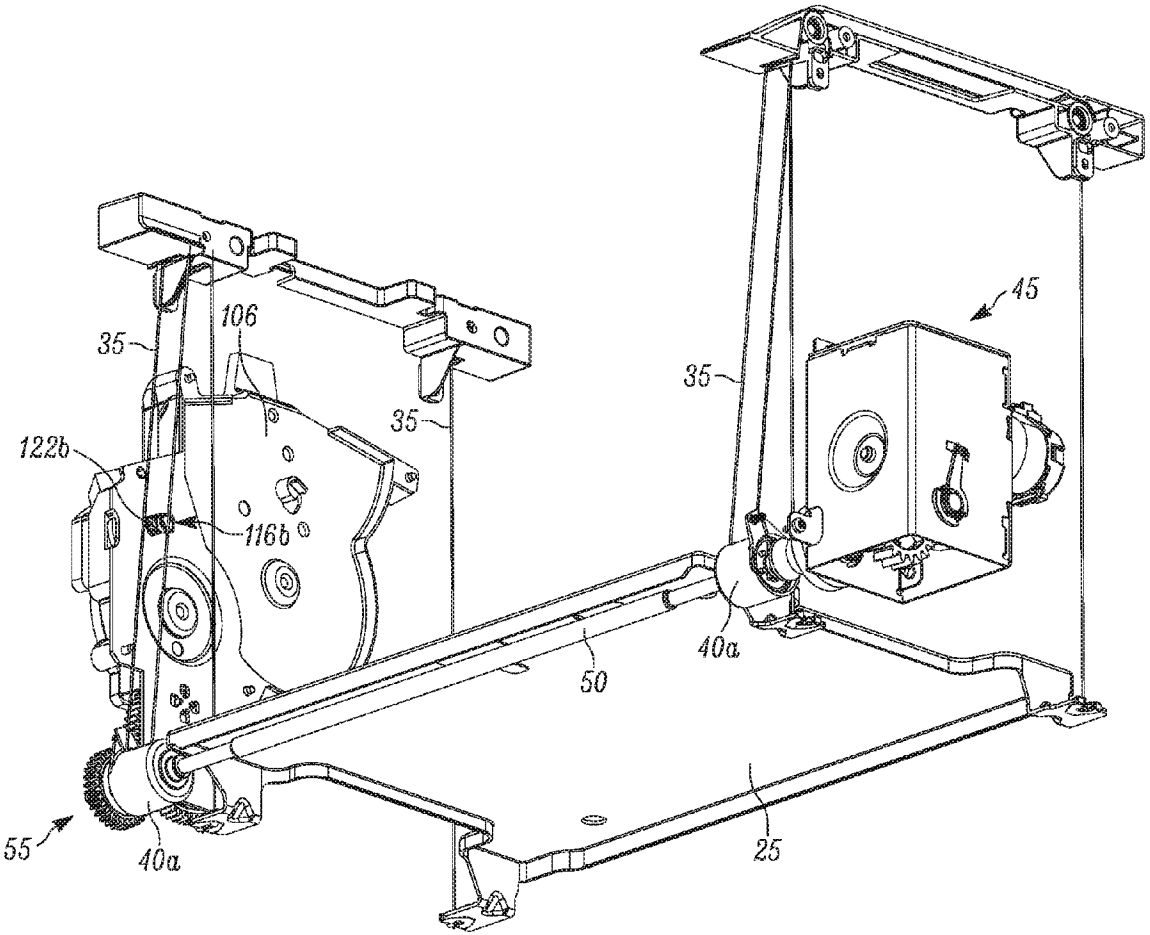
FIG. 4 is a bottom view of the damper assembly and media transport assembly of FIG. 2.
Figure 5:
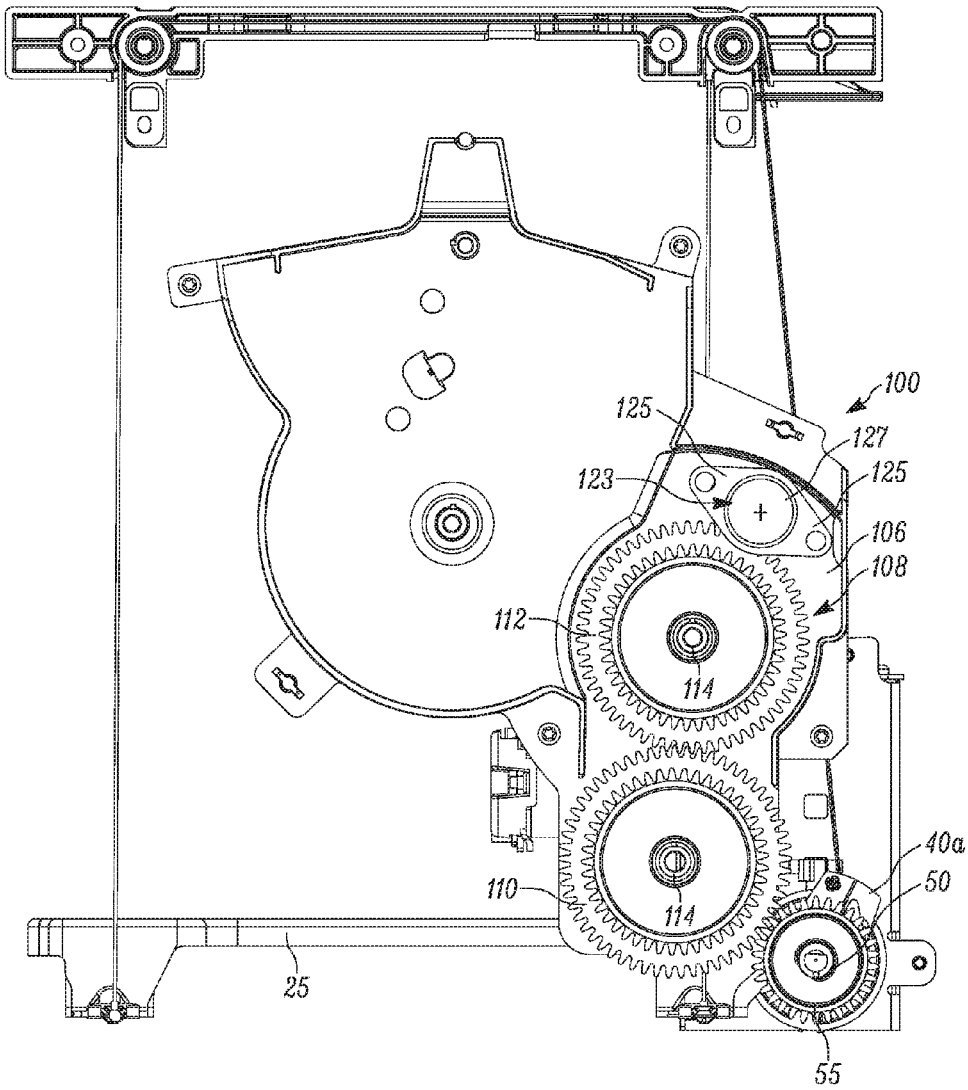
FIG. 5 is a section view of the damper assembly and media transport assembly of FIG. 2.

FIGS. 1-13 illustrate an example media transport assembly 20. Referring to FIGS. 1-8 and 13, the media transport assembly 20 can be part of a device 22, such as a printer, copier, facsimile machine, or any other device that prints images on replaceable media. It is appreciated that the illustrated location of the media transport assembly 20 inside the device 22 can be altered as may be necessary to satisfy design requirements. The media transport assembly 20 includes a media tray 25 connected to fixed support arms 30 by a series of cables 35 and pulleys 40, 40*a*. The cables 35 and pulleys 40, 40*a* cooperate to move the media tray 25 relative to the support arms 30 in a feeding direction (A) and a loading direction (B). A drive system 45 rotates drive pulleys 40*a* via an axle 50 (FIG. 4) on which the drive pulleys are mounted. An axle gearwheel 55 is mounted on the axle 50 for synchronous rotation with the drive pulleys 40*a*.

The media transport assembly 20 further includes a housing 102 having a cover 104 and a body 106. A transmission 108 (FIG. 7) is provided inside the housing 102. The transmission 108 includes first and second gearwheels 110, 112 rotatably mounted on stubs 114 on the body 106. The axle gearwheel 55 is in meshing engagement with the first gearwheel 110. Consequently, rotation of the axle gearwheel 55 by the drive system 45 results in rotation of the first gearwheel 110.

The housing 102 includes a slot 116 extending from a first end 118 to a second end 120. The slot 116 is defined by a first arcuate slot 116*a* extending through the cover 104 and a corresponding second arcuate slot 116*b* extending through the body 106. The second arcuate slot 116*b* is aligned with the first arcuate slot 116*a*.

Figure 6A:
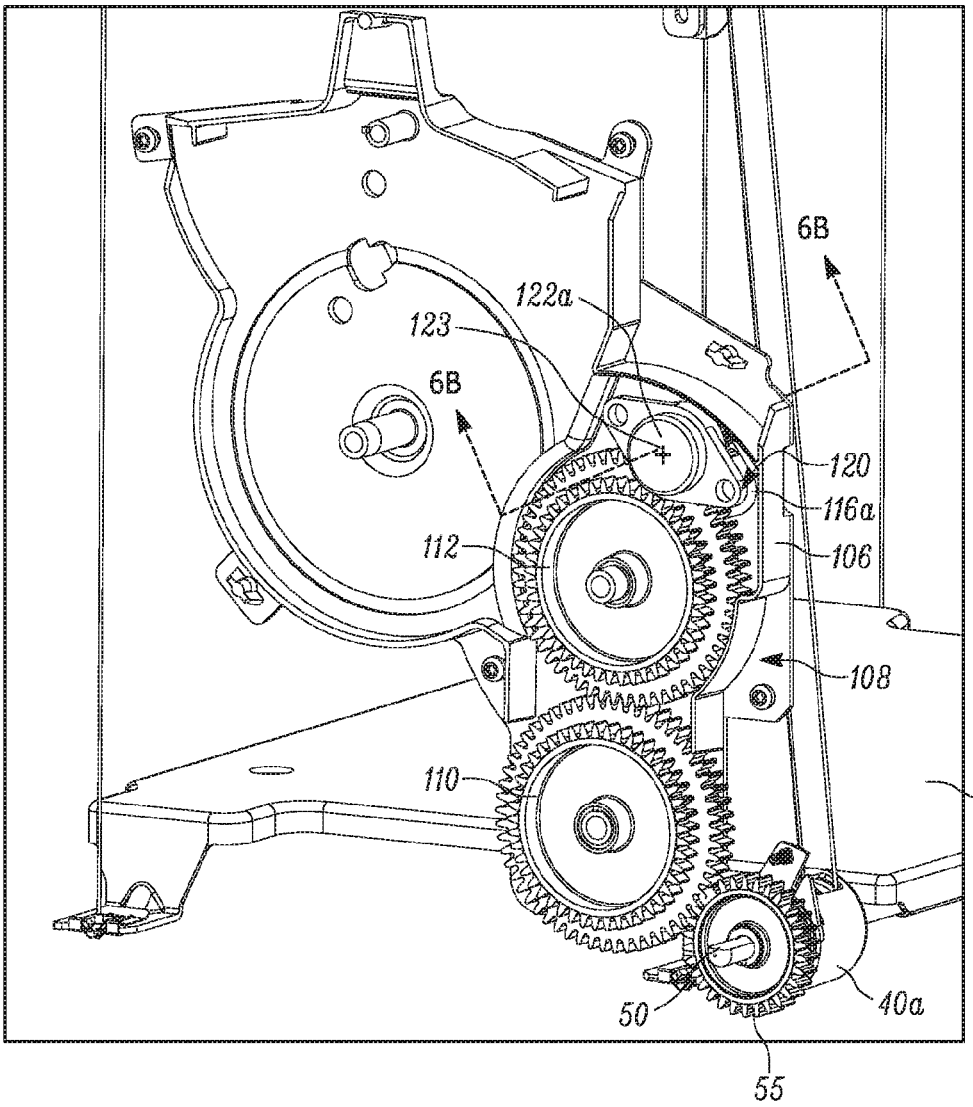
FIG. 6A is an enlarged view of the damper assembly and media transport assembly of FIG. 5.
Figure 6B:
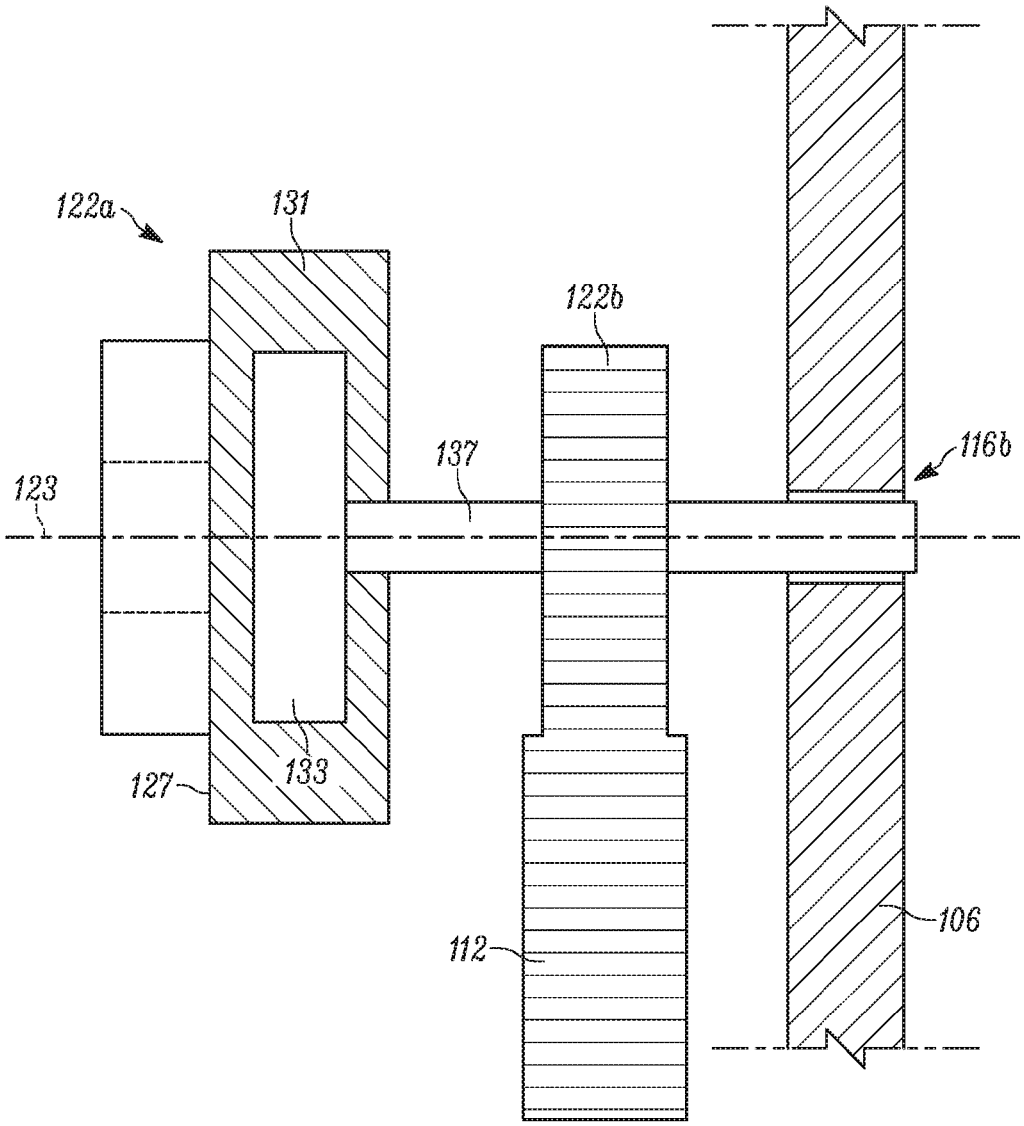
FIG. 6B is a sectional view of FIG. 6A taken along line 6B-6B.
Figure 7:
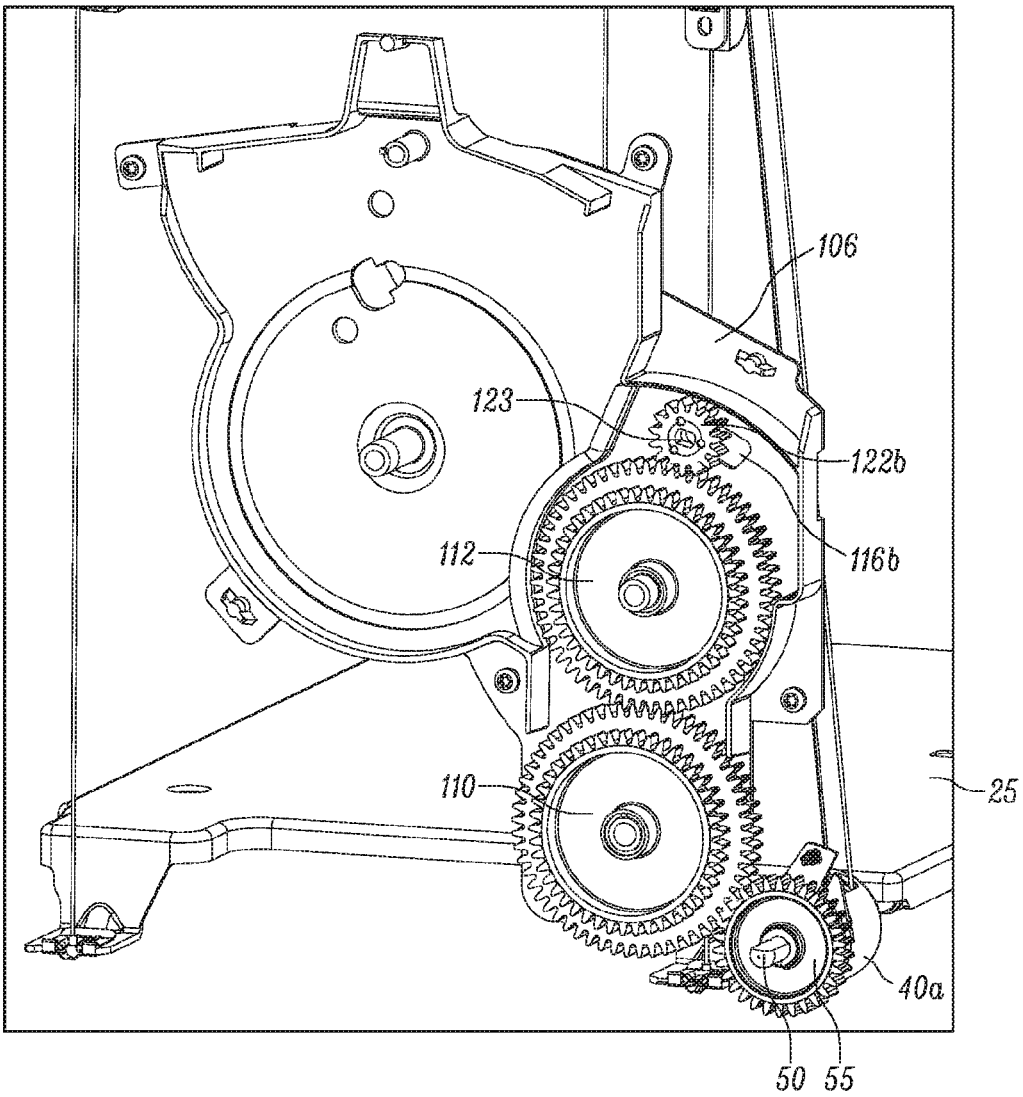
FIG. 7 is an enlarged view of the damper assembly and media transport assembly of FIG. 5 with a portion of the damper removed.
Figure 8:
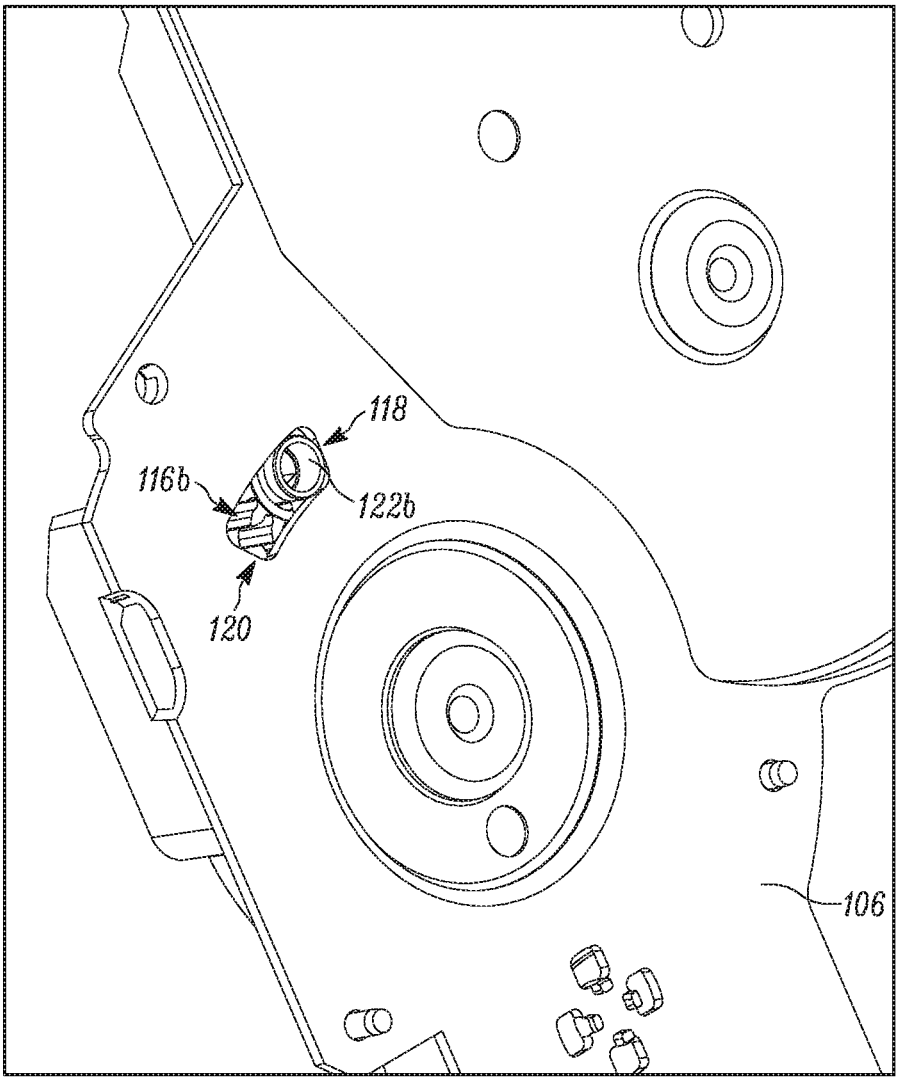
FIG. 8 is a rear view of a body of the damper assembly and media transport assembly of FIG. 2.
Figure 9:
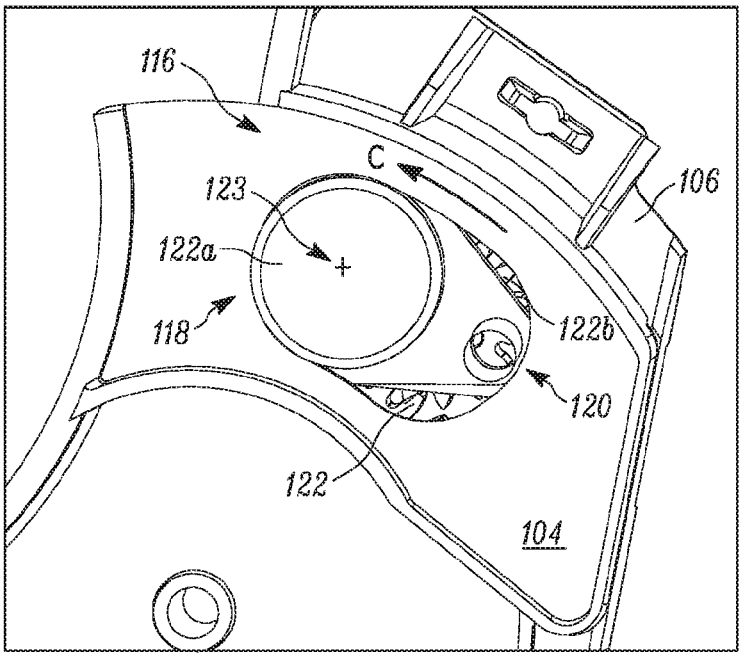
FIG. 9 is an enlarged view of the damper assembly and media transport assembly of FIG. 2 illustrating the damper in a first condition.
Figure 10:
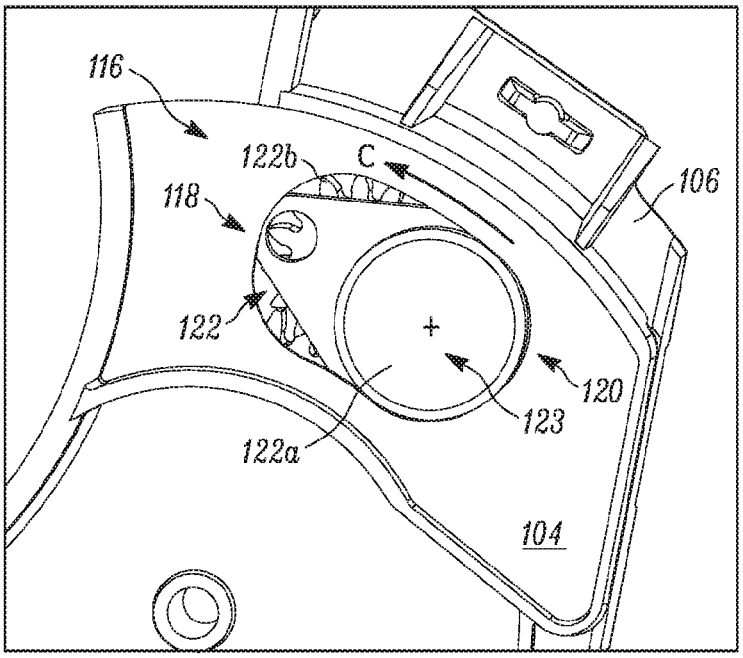
FIG. 10 is an enlarged view of the damper assembly and media transport assembly of FIG. 2 illustrating the damper in a second condition

A damper 122 is received in the slot 116. As shown in FIGS. 6A-8, the damper 122 includes a damper member 122*a* extending through the first slot 116*a* (FIGS. 2 and 3) and a damper gearwheel 122*b* extending through the second slot 116*b* (FIGS. 7 and 8). The damper gearwheel 122*b* is rotatably connected to the damper member 122*a* and shares a common axis of rotation 123.

The damper member 122*a* includes a two tabs 125 extending from opposite sides of a cylindrical portion 127. The specific mechanics of the damper member 122*a* can be of the type described in U.S. Pat. No. 4,691,811. Referring to FIG. 6B, the damper member can include a viscous liquid 131 contained within the cylindrical portion 127. A rotor 133 is disposed in the viscous liquid and coupled for rotation with the damper gearwheel 122*b* by a shaft 137. The rotation of the rotor 133, and thus the damper gearwheel 122*b*, is resisted by the viscous liquid 131, thereby providing the desired resistance and damping effect.

It is appreciated that any other suitable damper member can be used. In any case, the damper gearwheel 122*b* is in meshing engagement with the second gearwheel 112 (see FIG. 7). It is appreciated that the gear ratios of the axle gearwheel 50, the transmission 108, and the damper gearwheel 122*b* are selected such that the damper gearwheel 122*b* rotates more quickly than the axle 50. Alternatively, the gear ratios of the axle gearwheel 50, the transmission 108, and the damper gearwheel 122*b* can be selected such that the damper gearwheel 122*b* rotates slower than, or at a rate equal to, the axle 50. Furthermore, it is appreciated that the transmission 108 can be omitted such that the damper gearwheel 122*b* is in direct meshing engagement with the axle gearwheel 55. Further, it is appreciated that modifications can be made to the cover 104 and the body 106 to change the location of the slot 116 in order to accommodate the omission of the transmission 108.

The damper 122 is slideable along the slot 116 from the first end 118 (see FIG. 9) to the second end 120 (see FIG. 10) such that the axis of rotation 123 translates between the slot ends. The damper gearwheel 122*b* can move from the first end 118 to the second end 120 of the slot 116 and also rotate a full 360° about the axis of rotation 123. It is appreciated that the specific path of the damper 122 during translational movement of the axis of rotation 123 can be controlled by a swingarm arrangement instead of the illustrated slot 116. For example, a swingarm can be pivotally attached at opposite ends to the housing 102 and the damper 122.

Figure 11A:
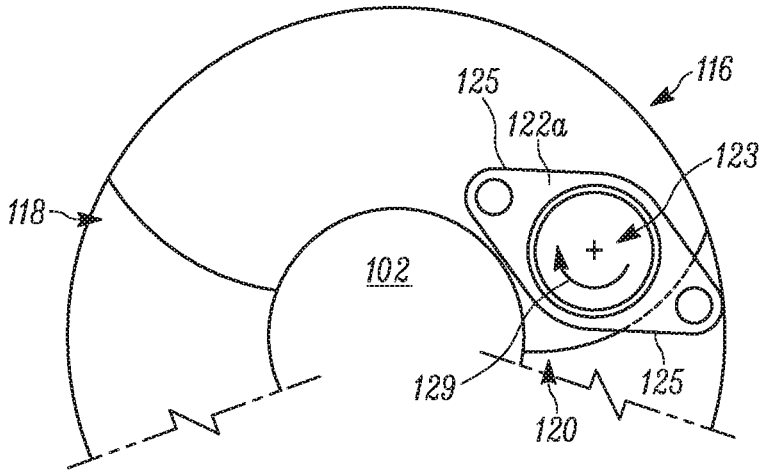
FIGS. 11A and 11B are schematic illustrations of the damper assembly and media transport assembly of FIG. 2 showing the damper rotated to a first locus and a third locus, respectively.
Figure 11B:
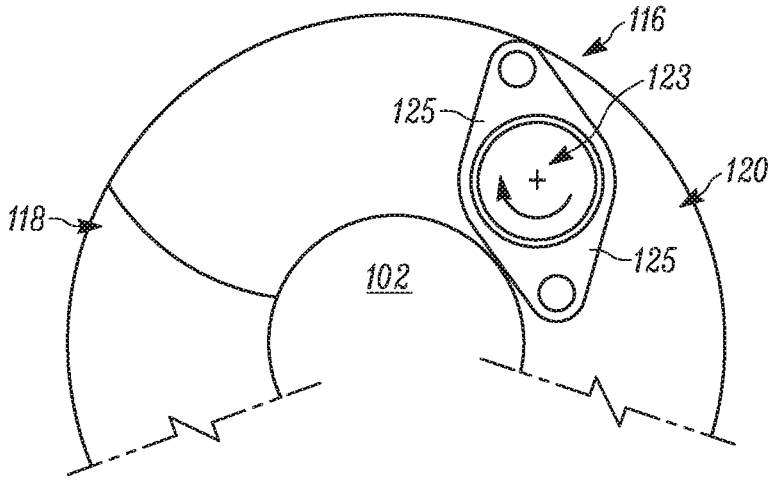
Figure 12A:
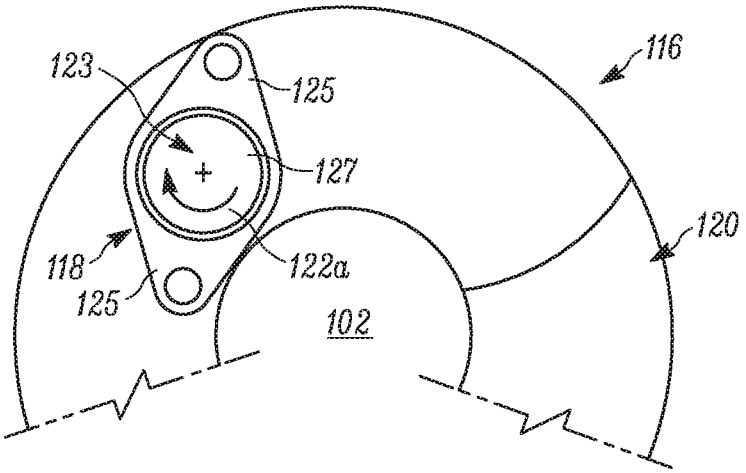
FIGS. 12A and 12B are schematic illustrations of the damper assembly and media transport assembly of FIG. 2 showing the damper rotated to a second locus and a fourth locus, respectively.
Figure 12B:
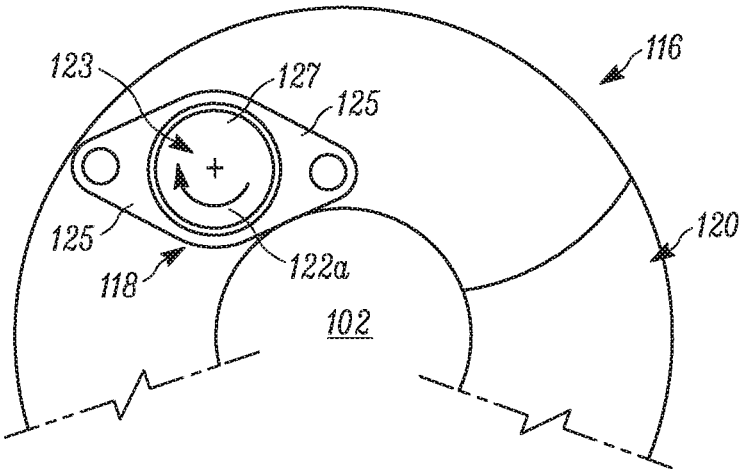
Figure 13:
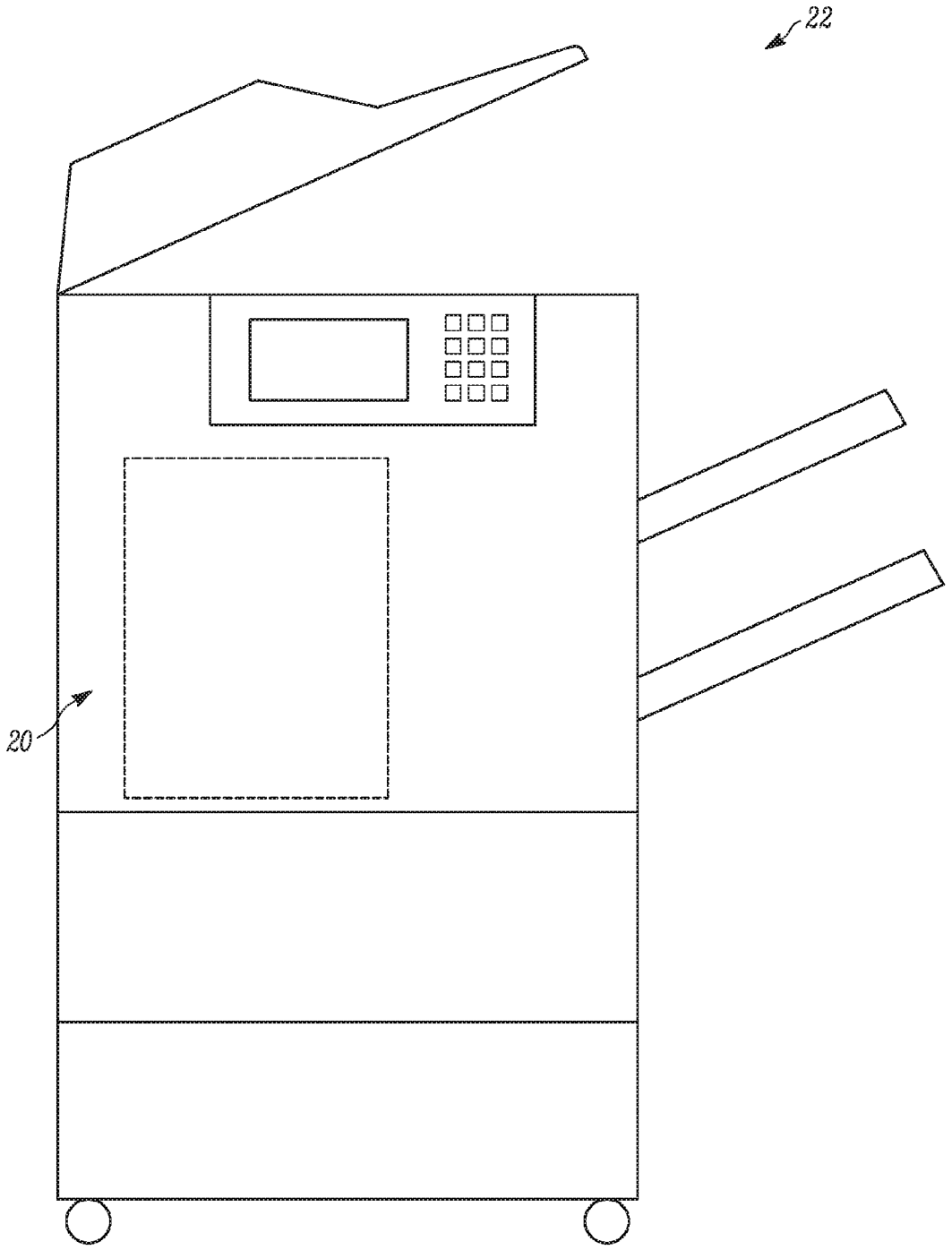
FIG. 13 is a printer including the damper assembly and media transport assembly of FIG. 2.

The damper member 122*a* translates with the damper gearwheel 122*b* along the slot 116, but is constrained to limited rotation about the axis of rotation 123 in a counterclockwise direction between a first locus and second locus (see FIGS. 11A and 12A, respectively) and in a clockwise direction between a third locus and a fourth locus (see FIGS. 11B and 12B, respectively). That is, the damper member 122*a* is prevented from rotating 360° about the axis of rotation. At the first locus and second locus, the damper member 122*a* is rotated to its furthest counterclockwise rotational extent (when viewed in FIGS. 9 and 10). At the third locus and fourth locus, the damper member 122*a* is rotated to its furthest clockwise rotational extent (when viewed in FIGS. 8 and 9).

As can be seen in FIGS. 11A, 11B, 12A, and 12B, the limited rotation of the damper member 122*a* is a result of contact between the tabs 125 and the housing 102. It is appreciated that the dimensions of the various components illustrated in FIGS. 11A, 11B, 12A, and 12B have been exaggerated in order to better illustrate the movement of the damper 122. Furthermore, it is appreciated that the damper member 122*a*, the slot 116, and other components illustrated in FIGS. 11A, 11B, 12A, and 12B can also be formed exactly as illustrated in FIGS. 11A, 11B, 12A, and 12B. Additionally, it is appreciated that the slot 116 can be configured to prevent any degree of rotation of the damper member 122*a*, including all rotation, at any position along the slot 116.

During operation of the device 22, media is sequentially removed from the media tray 25 until it is necessary to replenish the media supply. When it is desired to replenish the media supply, the media tray 25 is moved in the loading direction (B) (see FIG. 2). Alternatively, an operator may wish to check on the media supply level, which can require moving the media tray 25 in the loading direction (B). In either case, moving the media tray 25 in the loading direction (B) is accomplished by energizing the drive system 45 to rotate the axle 50 in an unwinding direction (counterclockwise when viewed in FIGS. 3 and 5). Rotation of the axle 50 in the unwinding direction causes likewise rotation of the drive pulleys 40*a* and the axle gearwheel 55. As the drive pulleys 40*a* rotate in the unwinding direction, the cables 35 are unwound from the respective drive pulleys 40*a*, thereby lowering the media tray 25 in the loading direction (B). Rotation of the axle gearwheel 50 is also transmitted to the damper member 122*a* via the transmission 108 and the damper gearwheel 122*b*.

The effect of the damper 120 on movement of the media tray 25 in the loading direction (B) is dependent on the location of the damper 122 within the slot 116, as well as the rotational position of the damper member 122*a* relative to the axis of rotation 123. If the damper 122 is located at the second end 120 of the slot 116 (see FIG. 10) or otherwise spaced from the first end 118 of the slot 116, the damper 122 is in a first condition in which the gearwheel 122*b* is held rotationally blocked relative to the damper member 122*a* by the resistance provided by the damper member 122*a*. However, since the location of the damper 122 is not fixed within the slot 116, rotation of the second gearwheel 112 during unwinding moves the rotationally blocked damper gearwheel 122*b* toward the first end 118 of the slot 116 in direction (C) (compare FIGS. 9 and 10). Accordingly, the damper 122 translates within the slot 116 and moves toward the first end 118 of the slot 116 without damping movement of the media tray 25 in the unloading direction (B).

Once the damper 122 reaches the first end 118 and is no longer able to translate (see FIG. 9), further rotation of the second gearwheel 112 results in rotation of the damper gearwheel 122*b* about the rotational axis 123 in the counterclockwise direction. If the damper member 122*b* is at the fourth locus once the damper 122 is moved to the first end 118 (see FIG. 12B), the damper member 122*b* rotates with the damper gearwheel 122*a* in the counterclockwise direction 127 until the damper member is positioned at the second locus, at which point further rotation of the damper member 122*b* in the counterclockwise 127 direction (when viewed in FIGS. 12A and 12B) is prevented and the damper 122 is placed in a second condition in which the damper gearwheel 122*b* is rotatable relative to the damper member 122*b*.

If the damper member 122*b* is already at the second locus once the damper 122 is moved to the second end 120 (see FIG. 12A), the damper 122 is already in the second condition and the damper gearwheel 122*b* immediately begins rotation relative to the damper member 122*b* when the second gearwheel 112 is rotated in the unwinding direction.

Once relative rotation between the damper gearwheel 122*b* and the damper member 122*b* is achieved, the damper 122 regulates the rotational speed of the transmission 108, the axle gearwheel 55, the axle 50, and the drive pulleys 40*a* in the unwinding direction. Consequently, further movement of the media tray 25 in the loading direction (B) is slowed to a predetermined rate. This arrangement allows the drive pulleys 40*a* to control unwinding of the cables 35 to move the media tray 28 in the loading direction (B) at a first rate, and then cooperate with the damper 120 to move the media tray 25 in the loading direction at a second rate slower than the first rate. It is appreciated that the drive system 45 can be arranged such that movement of the media tray 25 in the loading direction (B) is carried out a fixed rate when the drive pulleys 40*a* are actively being driven to move the media tray 25 in the loading direction (B). That is, the drive system 45 can be arranged to move the media tray 25 in the loading direction (B) at a constant desired rate regardless of the location/position of the damper 120.

Additionally, any backlash in the gear train consisting of the axle gearwheel 55, the transmission 108, and the damper gearwheel 122*b* can allow for further initial movement of the media tray 25 at the first rate in the loading direction (B).

It is appreciated that movement of the media tray 25 in the loading direction (B) can alternatively solely be the result of the force of gravity acting on the media tray 25. That is, instead of operating the drive system 45 to actively move the media tray 25 in the loading direction (B), the media transport assembly 20 can be provided with a disconnect mechanism or one-way clutch that disconnects the drive system 45 from the remainder of the assembly when it is desired for the media tray 25 to move in the loading direction (B). In this arrangement, when it is desired to have the media tray 25 move in the loading direction (B), the disconnect mechanism is actuated, thereby permitting the media tray 25 to freefall in the loading direction (B) under the force of gravity until the damper 122 is moved to the second locus. Once the damper 122 is at the second locus, further movement of the media tray 25 in the loading direction (B) is slowed to the predetermined rate.

The media tray 25 is moved in the feeding direction (A) (see FIG. 2) during operation of the device 22 to supply media to a media feeder (not shown). To move the media tray in the feeding direction (A), the drive system 45 is energized to rotate the axle 50 in a winding direction (clockwise when viewed in FIGS. 2 and 4). Rotation of the axle 50 in the winding direction causes likewise rotation of the drive pulleys 40*a* and the axle gearwheel 55. As the drive pulleys 40*a* rotate in the unwinding direction, the cables 35 are wound onto the respective drive pulleys 40*a*, thereby raising the media tray 25 in the feeding direction (A).

Rotation of the axle gearwheel 50 is also transmitted to the damper member 122*a* via the transmission 108 and the damper gearwheel 122*b*.

The effect of the damper 120 on movement of the media tray 25 in the feeding direction (A) is dependent on the location of the damper 122 within the slot 116, as well as the rotational position of the damper member 122*a* relative to the axis of rotation 123. If the damper 122 is located at the first end 118 of the slot 116 or otherwise spaced from the second end 120 of the slot 116, the damper 122 is in the first condition in which the gearwheel 122*b* is held rotationally blocked relative to the damper member 122*a* by the resistance provided by the damper member 122*a*. However, since the location of the damper 122 is not fixed within the slot 116, rotation of the second gearwheel 112 during winding moves the rotationally blocked damper gearwheel 122*b* toward the second end 120 of the slot 116. Accordingly, the damper 122 translates within the slot 116 and moves toward the second end 120 of the slot 116 without damping movement of the media tray 25 in the feeding direction (A).

Once the damper 122 reaches the second end 120 and is no longer able to translate, further rotation of the second gearwheel 112 results in rotation of the damper gearwheel 122*b* in the clockwise direction 129. If the damper member 122*b* is at the first locus once the damper 122 is moved to the second end 120 (see FIG. 11A), the damper member 122*b* rotates with the damper gearwheel 122*a* in the clockwise direction 129 until the damper member is positioned at the third locus, at which point further rotation of the damper member 122*b* in the clockwise direction (when viewed in FIGS. 11A and 11B) is prevented and the damper 122 is placed in the second condition in which the damper gearwheel 122*b* is rotatable relative to the damper member 122*b*.

If the damper member 122*b* is already at the third locus once the damper 122 is moved to the second end 120 (see FIG. 11B), the damper 122 is already in the second condition and the damper gearwheel 122*b* immediately begins rotation relative to the damper member 122*b* when the second gearwheel 112 is rotated in the winding direction.

Once relative rotation between the damper gearwheel 122*b* and the damper member 122*b* is achieved, the damper 122 regulates the rotational speed of the transmission 108, the axle gearwheel 55, the axle 50, and the drive pulleys 40*a* in the winding direction. Consequently, further movement of the media tray 25 in the feeding direction (A) is slowed to a predetermined rate. This arrangement allows the drive pulleys 40*a* to control winding of the cables 35 to move the media tray 28 in the feeding direction (A) at a third rate, and then cooperate with the damper 120 to move the media tray 25 in the feeding direction at a fourth rate slower than the third rate. Additionally, any backlash in the gear train consisting of the axle gearwheel 55, the transmission 108, and the damper gearwheel 122*b* can allow for further initial movement of the media tray at the third rate in the feeding direction (A).

It is appreciated that, in another example, the drive system 45 can be a closed loop velocity system such that the movement of the media tray 25 in the feeding direction (A) is carried out at a fixed rate. That is, the drive system 45 can be arranged to move the media tray 25 in the feeding direction (A) at a constant desired rate regardless of the location/position of the damper 120.

It will be appreciated that, due to the multiple degrees of freedom of the damper member 122*a*, the motion of the damper member 122*a* can diverge from the specific motion described above. For example, the damper member 122*a* can rotate about the axis of rotation 123 and move from the fourth locus to the third locus before reaching the first end 118 of the slot 116. Similarly, the damper member 122*a* can rotate about the axis of rotation 122*a* and move from the first locus to the second locus before reaching the second end 120 of the slot 116. Regardless of whether the damper member 122*a* rotates about the axis of rotation 123 before translating, or translates before rotating about the axis of rotation, one having ordinary skill in the art will appreciate that the design of the media transport assembly 10 is such that the damper 122 does not damp movement of the media tray 25 until relative rotation between the damper member 122*a* and the damper gearwheel 122*b* occurs and the clearance associated with the backlash of the gear train (if any) is taken up.

The configuration of the media transport assembly 20 is advantageous in that it allows the media tray 25 to initially be moved in the loading direction (B) at a relatively higher rate of speed, thereby preventing the media tray 25, and the media contained on the media tray, from clashing with other components of the device 22. It is appreciated that the media transport assembly 20 can be arranged to allow for 12 mm of movement of the media tray 25 at the relatively higher rate of speed in the loading direction (B). Furthermore, it is appreciated that the media transport assembly 20 can be arranged to allow for movement of the media tray 25 at the relatively higher rate of speed in the loading direction (B) for a distance that is greater than or less than 12 mm. Movement of the media tray 25 is still damped, thereby ensuring good safety and acoustic characteristics. Additionally, rubber bumpers can be provided to the media transport assembly 20 and arranged to absorb motion of the media tray 25 in the loading direction (B) at the end of travel of the media tray 25 to further provide good safety and acoustic characteristics. Similarly, the configuration of the media transport assembly 20 allows the media tray 25 to initially be moved in the feeding direction (A) at a relatively higher rate of speed, thereby reducing printer downtime after additional media has been loaded into the printer.

What is claimed is:

1. An assembly of a device having a component, the assembly comprising:

a damper including a damper gearwheel coupled to a damper member, the damper member having a first condition restricting motion of the component to a first rate in a first direction and a second condition restricting motion of the component to a second rate in the first direction slower than the first rate, the damper gearwheel being rotationally fixed relative to the damper member when the damper is in the first condition, the damper gearwheel being rotatable relative to the damper member when the damper is in the second condition; and a housing having a slot extending from a first end to a second end for slidably receiving the damper member, the damper moving from the first end toward the second end when in the first condition and rotating within the second end when in the second condition.

2. The assembly according to claim 1, wherein the damper member comprises a rotary damper.

3. The assembly according to claim 1, wherein the slot is arcuate such that the damper member and the damper gearwheel move in a circumferential path.

4. The assembly according to claim 1, further comprising a drive system and a transmission for transmitting motion of the drive system to the damper.

5. The assembly according to claim 4, wherein the damper gearwheel is rotationally fixed to the transmission when the damper is in the first condition, and wherein the damper gearwheel is rotated by the transmission when the damper is in the second condition.

6. The assembly according to claim 1, wherein gravity causes the component to move at the first rate in the first direction.

7. An assembly of a device, comprising:

a tray to receive media;

a drive system to move the tray along a loading direction from a first position to a second position;

a damper connected to the drive system for damping movement of the tray in the loading direction, the damper having a first condition translating relative to the drive system such that the tray moves at a first rate in the loading direction, the damper having a second condition fixed in position for rotation by the drive system such that the tray moves at a second rate in the loading direction slower than the first rate; and a housing having a slot extending from a first end to a second end for slidably receiving the damper, the damper moving from the first end toward the second end when in the first condition and rotating within the second and when in the second condition.

8. The assembly according to claim 7, wherein the slot is arcuate such that the damper moves translationally circumferential path.

9. The assembly according to claim 7 further comprising a transmission for transmitting motion of the drive system to the damper.

10. The assembly according to claim 9, wherein the transmission includes two stepped gearwheels.

11. The assembly according to claim 9, wherein the damper includes at least one damper gearwheel coupled to the transmission for placing the damper in the first condition and the second condition.

12. The assembly according to claim 11, wherein the damper gearwheel is rotationally fixed to the transmission when the damper is in the first condition, and wherein the damper gearwheel is rotated by the transmission when the damper is in the second condition.

13. The assembly accordingly to claim 9, wherein the damper gearwheel and the damper member share a common axis of rotation.

14. An assembly of a device, comprising:

a tray to receive media;

a drive system to move the tray along a loading direction from a first position to a second position;

a transmission rotatably coupled to the drive system;

a damper connected to the drive system by the transmission, the damper including a damper member and a damper gearwheel coupled to the damper member, the damper having a first condition restricting motion of the tray to a first rate in the loading direction and a second condition restricting motion of the tray to a second rate in the loading direction slower than the first rate, the damper gearwheel being rotationally fixed relative to the damper member when the damper is in the first condition, the damper gearwheel being rotatable relative to the damper member when the damper is in the second condition; and a housing having an arcuate slot that extends from a first end toe second end and in which the damper member is slidably received, the damper moving from the first end toward the second end when in the first condition and rotating within the second end when in the second condition.

15. The assembly according to claim 14, wherein the damper member and the damper gearwheel share a common axis of rotation.

* * * * *